US007712409B2

(12) United States Patent
Cunningham et al.

(10) Patent No.: US 7,712,409 B2
(45) Date of Patent: May 11, 2010

(54) MODULAR BODY FOR USE ON AN ARMORED VEHICLE

(75) Inventors: Brock D. Cunningham, Maineville, OH (US); Kevin M. Klatte, Milford, OH (US); David Wolf, Batavia, OH (US)

(73) Assignee: Armor Holdings, Inc., Fairfield, OH (US)

( * ) Notice: Subject to any disclaimer, the term of this patent is extended or adjusted under 35 U.S.C. 154(b) by 811 days.

(21) Appl. No.: 11/613,401

(22) Filed: Dec. 20, 2006

(65) Prior Publication Data

US 2010/0077913 A1 Apr. 1, 2010

Related U.S. Application Data

(60) Provisional application No. 60/752,073, filed on Dec. 20, 2005.

(51) Int. Cl.
*F41H 5/14* (2006.01)

(52) U.S. Cl. ..... 89/36.09; 89/36.11; 89/36.12

(58) Field of Classification Search ..... 89/36.07–36.12
See application file for complete search history.

(56) References Cited

U.S. PATENT DOCUMENTS

| | | | | |
|---|---|---|---|---|
| 4,643,477 | A | 2/1987 | Kovatch | |
| 5,074,611 | A | 12/1991 | Newkirk | |
| 5,474,352 | A * | 12/1995 | Davies | 296/24.3 |
| 5,533,781 | A | 7/1996 | Williams | |
| 5,663,520 | A | 9/1997 | Ladika et al. | |
| 6,101,917 | A | 8/2000 | Klatte et al. | |
| 6,327,954 | B1 * | 12/2001 | Medlin | 89/36.08 |
| 7,225,717 | B2 * | 6/2007 | Williams | 89/36.08 |
| 7,383,761 | B2 * | 6/2008 | Warren et al. | 89/36.02 |
| 7,393,045 | B1 * | 7/2008 | Gonzalez | 296/190.04 |

(Continued)

FOREIGN PATENT DOCUMENTS

GB 2071829 A * 9/1981

(Continued)

OTHER PUBLICATIONS

Michael S. Boczek, Lethal Threat Protection System for a Vehicle and Method, co-pending U.S. Appl. No. 10/958,043, filed Oct. 4, 2004, 36 pages, United States.

(Continued)

*Primary Examiner*—Gabriel J Klein
(74) *Attorney, Agent, or Firm*—Wood, Herron & Evans, LLP

(57) ABSTRACT

A modular armored cab kit is provided for use on an armored vehicle that includes a cab body having a frame, an armored roof, an armored floor and a plurality of attachment elements, with the roof, floor and attachment elements being permanently attached to the frame. The cab kit further includes at least one non-armored panel, at least one non-armored door, at least one armored panel and at least one armored door, each for attachment to the cab body. The attachment elements facilitate field installation and removal of the panels and doors, wherein the non-armored panel and door are removably attached to the frame in a relatively low threat environment and are removed from the frame and replaced with the armored panel and door in a heightened threat environment.

12 Claims, 5 Drawing Sheets

U.S. PATENT DOCUMENTS

2006/0201319 A1 * 9/2006 De Wet ..... 89/36.09
2006/0288856 A1 * 12/2006 Labock ..... 89/36.04
2009/0056529 A1 * 3/2009 Hinze et al. ..... 89/36.08

FOREIGN PATENT DOCUMENTS

WO WO 2006085926 A2 * 8/2006
WO WO 2009034372 A1 * 3/2009
WO WO 2009034374 A1 * 3/2009

OTHER PUBLICATIONS

Ronan Floch, Armored Shell Kit and Associated Method of Armoring a Vehicle, co-pending U.S. Appl. No. 11/536,968, filed Sep. 29, 2006, 21 pages, United States.

* cited by examiner

MODULAR BODY FOR USE ON AN ARMORED VEHICLE

CROSS-REFERENCES

This application claims the priority benefit of U.S. Provisional Patent Application Ser. No. 60/752,073, "Armor Ready Vehicle Body", filed Dec. 20, 2005, which is expressly incorporated by reference herein in its entirety.

FIELD OF THE INVENTION

This invention relates generally to armoring and more particularly, to an armor ready module for use on an armored vehicle.

BACKGROUND OF THE INVENTION

There are many ways to provide armor protection for ground systems, for example, commercial and military vehicles and structures. Various examples of armoring ground systems include, but are not limited to, installing an armor add-on kit to a preexisting body or building the body out of armor materials. Both of these methodologies have some advantages but many disadvantages.

An armor add-on kit is usually used when a vehicle is designed for applications that do not require protecting its occupants against direct or indirect ballistic fire and blast threats. With an add-on kit, the body of the vehicle must be reinforced so that the armor components can be attached to the vehicle structure to protect the occupants in a heightened threat environment. Overall, an add-on kit results in a heavier and more expensive vehicle system because the preexisting body is parasitic in both cost and weight. The preexisting body doesn't aid in defeating a threat and in some cases, can degrade armor performance. Therefore, the preexisting body only adds unwanted cost and weight. Other disadvantages include a reduction in the life cycle of the preexisting body and chassis, reduced fuel efficiency, long installation times and little modularity. Modularity relates to a capability of removing and/or replacing armor components.

Alternatively, a vehicle body can be replaced with, or redesigned as, a new body that is originally made with armor materials (i.e. 5/16" steel), so that the new body provides a desired and permanent complete armor system. Such a new body offers significant weight and cost advantages over vehicles using an add-on armor kit due to the parasitic cost and weight penalty of the preexisting base vehicle body. However, disadvantages include a reduction in life cycle for the chassis, reduced fuel efficiency and the inability to remove the armor. Further, the overall cost of the vehicle will be significantly higher due to the permanently armored body. In addition, the chassis will carry the heavier armor body for the entire life of the vehicle unless the entire body is replaced. Also, it is difficult, time consuming and costly to upgrade the armor of vehicles of this type, as new technology becomes available since the vehicle bodies are fabricated with a permanent armor system. In order to provide upgraded armor, the entire vehicle body or large components thereof would have to be removed and then replaced with a body having an upgraded armor system.

Thus, there is a need for an armoring system that does not have the disadvantages of the known systems discussed above.

SUMMARY OF THE INVENTION

According to a first aspect of the present invention, a modular armored cab kit is provided for use on an armored vehicle comprising a cab body including a frame, an armored roof, an armored floor and a plurality of attachment elements, with the roof, floor and attachments elements being permanently attached to the frame. The cab kit further comprises at least one non-armored panel, at least one non-armored door, at least one armored panel and at least one armored door, each for attachment to the cab body. The attachment elements facilitate field installation and removal of the panels and doors, whereby the non-armored panel and door are removably attached to the frame in a low threat environment and are removed from the frame and replaced with the armored panel and door in a heightened threat environment.

In other embodiments, the cab body can further include an armored firewall. The armored roof, armored floor, armored firewall and attachment elements can be welded to the frame. The kit can further include a plurality of the armored and non-armored panels, and at least one of each can include a windowpane. Also, the armored and non-armored doors can include a windowpane.

The attachment elements can comprise a plurality of weld nuts, or alternatively, the attachment elements can comprise a plurality of threaded inserts. The armored panel can include a first armored member and a second armored member bonded to said first armored member. The frame can include an underbody portion, an upper portion and a plurality of pillars extending between and attached to the underbody portion and the upper portion.

According to a second aspect of the present invention, a modular armored body kit is provided for use on an armored vehicle that comprises a body including a frame, at least one armored member, and a plurality of attachment elements, the armored member and the attachment elements being permanently attached to the frame. The kit further comprises at least one armored member for removable attachment to the body, wherein the attachment elements facilitate field installation of the armored member when the vehicle is in a heightened threat environment.

According to a third aspect of the present invention, a method is provided for converting an armored vehicle configured for a relatively low threat environment to an armored vehicle configured for a heightened threat environment. When the vehicle is configured for a relatively low threat environment, the vehicle comprises a cab body including a frame, an armored roof, an armored floor and a plurality of attachment elements, the roof, floor and attachment elements being permanently attached to the frame. The vehicle further comprises at least one non-armored panel removably attached to the frame by connecting the panel to a first plurality of the attachment elements and a non-armored door removably attached to the frame by connecting the non-armored door to a second plurality of the attachment elements. The method comprises the steps of removing the non-armored panel by disconnecting the non-armored panel from the first plurality of attachment elements and replacing the non-armored panel with an armored panel, wherein replacing the non-armored panel comprises removably attaching the armored panel to the frame by connecting the armored panel to the first plurality of attachment elements.

In other embodiments, the method can further comprise removing the non-armored door by disconnecting the non-armored door from the second plurality of attachment elements and replacing the non-armored door with an armored door, wherein replacing the non-armored door comprises removably attaching the armored door to the second plurality of attachment elements.

According to a fourth aspect of the present invention a method is provided for manufacturing an armored body for use on an armored vehicle comprising fabricating a frame, an armored roof and an armored floor and further comprising permanently attaching the roof and the floor to the frame. The method further comprises providing a plurality of female threaded fasteners and permanently attaching the female threaded fasteners to the frame, with each female threaded fastener being adapted to receive a male fastener for removably attaching armored or non-armored members to the frame.

In other embodiments, the method for manufacturing the body can further include fabricating a firewall and permanently attaching the firewall to the frame. The female threaded fasteners can be weld nuts. Alternatively, the female threaded fasteners can be threaded inserts. The roof, floor and firewall can be permanently attached to the frame by welding.

Many additional advantages and features of the invention will become more apparent upon review of the following detailed description.

BRIEF DESCRIPTION OF THE DRAWINGS

The accompanying drawings, which are incorporated in and constitute a part of the specification, illustrate an embodiment of the invention and, together with a general description of the invention given above, and the detailed description of the embodiment given below, serve to explain the principles of the invention.

DETAILED DESCRIPTION

The armor-ready body of the present invention, which can be an armor-ready cab body as shown in the illustrative embodiment, is designed to readily accept various armor add-on kits that can include non-armored or armored panels and non-armored or armored doors, as well as any corresponding windowpanes contained therein. The resultant armored body in accordance with the principles of the present invention can be used on a wide variety of armored vehicles, depending upon the particular configuration of the armored body. For example, the armored body can be used on armored vehicles that include, but are not limited to, armored construction vehicles such as High Mobility Engineering Excavation (HMEE) vehicles, for example the HMEE III various military trucks or other vehicles, such as Heavy Expanded Mobility Tactical Trucks (HEMTT), for example the HEMTT A2, and High Mobility Multipurpose Wheeled Vehicles (HMMWV), for example the M1151 HMMWV.

The particular configuration of the armored body will depend on whether the corresponding armored vehicle will be subjected to a relatively low threat environment or a heightened threat environment. In a relatively low threat environment, the armored vehicle could be exposed to environmental projectiles such as rocks, bricks, bottles and the like, and small arms projectiles for example. In a heightened threat environment, the armored vehicle could be exposed to various armor piercing projectiles and various blast devices such as improvised explosive devices (IEDs), grenades, and land mines, etc. However, as may be appreciated by one skilled in the art, the relatively low and heightened threat environments can include exposure to items other than those discussed above. In each instance, the armored body described herein includes a modular body, incorporating a frame and various armored members permanently attached to the frame and further includes a plurality of attachment elements permanently attached to the frame for removably attaching either non-armored panels and doors or armored panels and doors to the frame, depending upon the particular threat environment in which the armored vehicle will operate. Accordingly, the attachment elements facilitate field installation and removal of the foregoing panels and doors.

Figure 1:
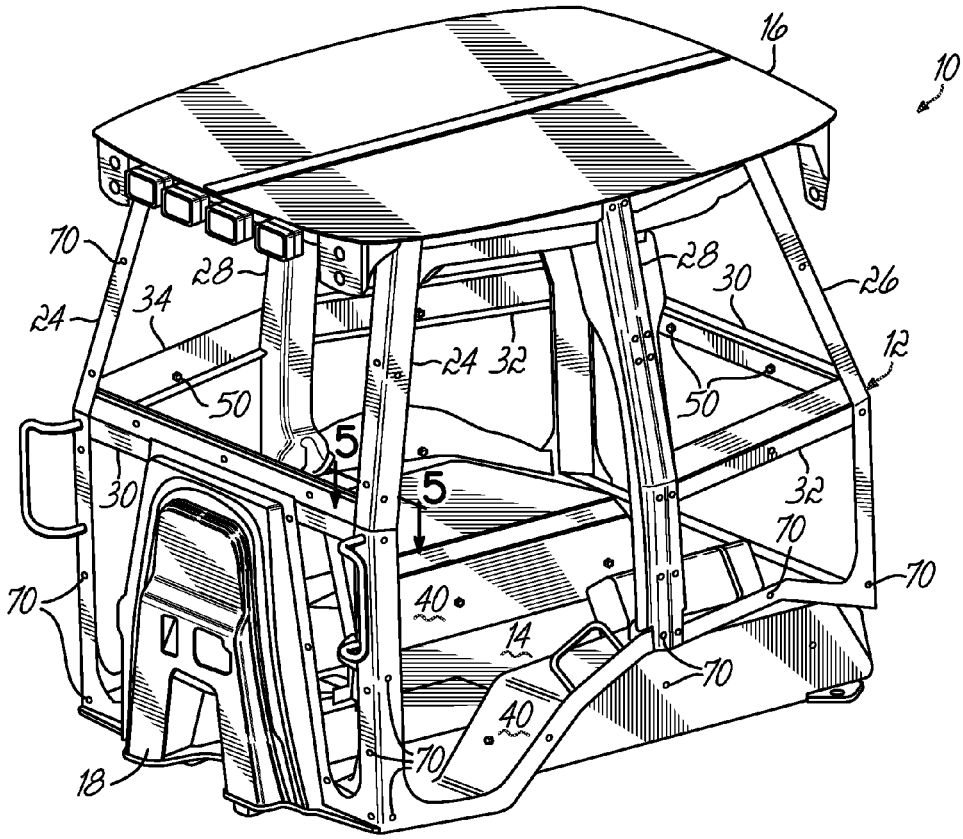
FIG. 1 is a perspective view illustrating a cab body.
Figure 7:
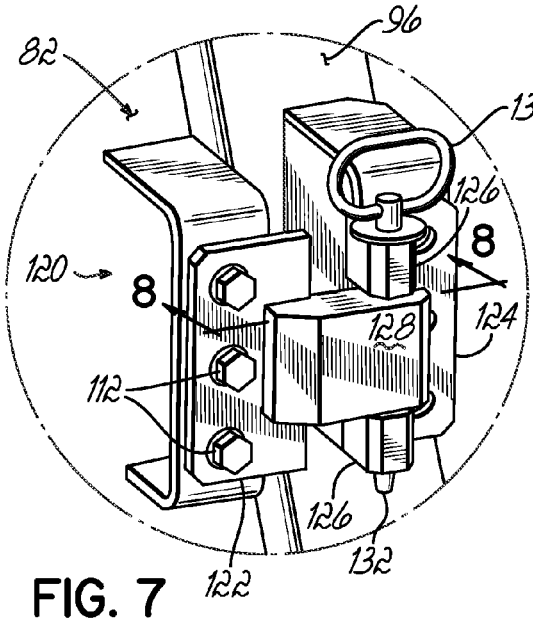
FIG. 7 is an enlarged view of the encircled portion of FIG. 3.
Figure 2:
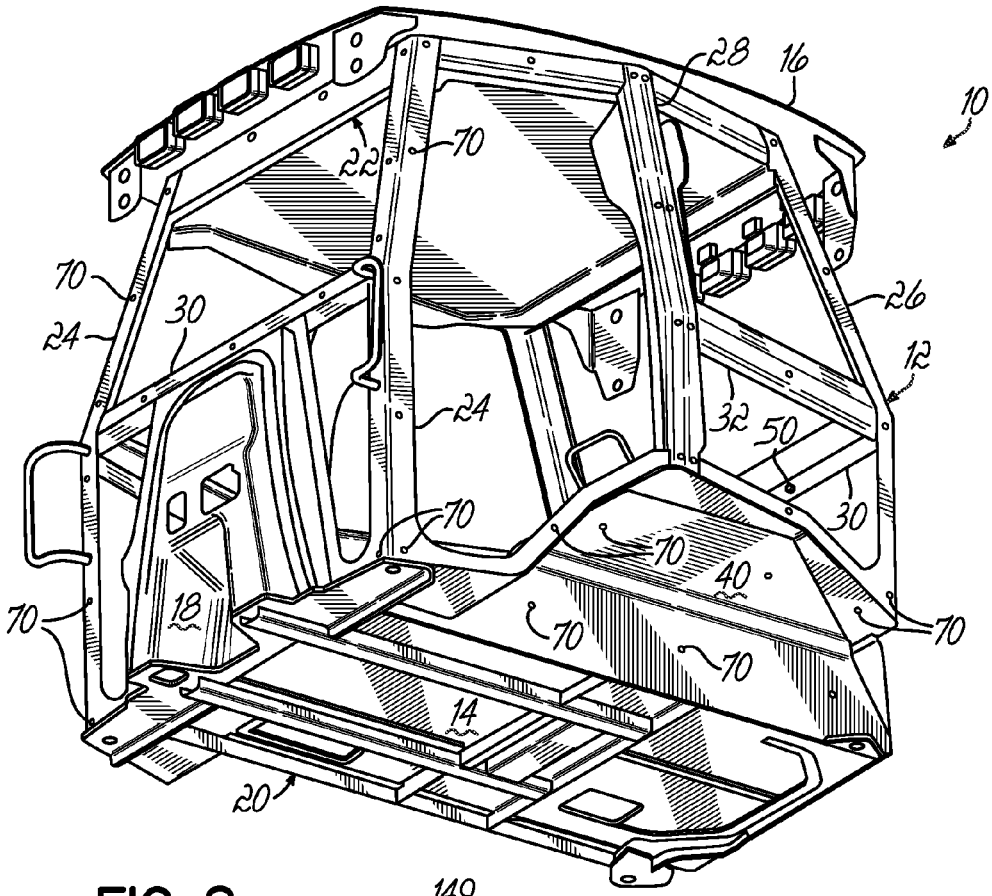
FIG. 2 is a perspective view further illustrating the cab body shown in FIG. 1.

FIGS. 1 and 2 illustrate a body, and more particularly a cab body 10 for use in an HMEE III, backhoe. The cab body 10 includes a frame 12 and a floor 14 permanently attached to the frame 12, for example by welding floor 14 to frame 12. The cab body 10 further includes a roof 16, which is also permanently attached to the frame 12, for example by welding roof 16 to frame 12. Cab body 10 can further include a firewall 18 permanently attached to the frame 12, for example by welding the firewall 18 to frame 12.

Frame 12 can include an underbody portion, indicated generally at 20, an upper portion 22 and a plurality of pillars that extend between and are attached to the underbody portion 20 and the upper portion 22. These pillars can include a pair of A-pillars 24 disposed at the forward end of the cab body 10, a pair of C-pillars 26 disposed at the rear end of the cab body 10 and a pair of B-pillars 28 disposed intermediate the A-pillars 24 and the C-pillars 26.

Frame 12 can further include a plurality of members that extend between and are connected to various ones of the foregoing pillars. For example, frame 12 can include a pair of cross members 30 with each extending between and attached to two of the A-pillars 24. Frame 12 can also include a pair of side members 32, with each extending between and attached to one of the B-pillars 28 and one of the C-pillars 26. Frame 12 can also include one or more cross members 34 extending between the A-pillar 24 and B-pillar 28 disposed on a side of body 10 opposite that to which a door is removably attached as subsequently discussed. The various members of frame 12 can be permanently attached to one another, for example by welding the various members of frame 12 to one another. Cab body 10 can further include a pair of wheelhouse panels 40 that can be permanently attached to the floor 14, for example by welding the wheelhouse panels 40 to floor 14.

Armored floor 14 and armored roof 16 can be made of a variety of materials. For example, floor 14 and roof 16 can be made of a high hard metallic armor, i.e., a metal having a hardness ranging from about 477 Brinell to about 543 Brinell as specified in MIL-A-46100. In one embodiment, floor 14 can be made of ⅜ inch thick high hard metallic armor and roof 16 can be made of 3/16 inch thick high hard metallic armor. Suitable metals that can be used include, but are not limited to, steel and aluminum. However, in other embodiments, the thicknesses of the high hard metallic armor can be different than those listed above. Additionally, in other embodiments, floor 14 and roof 16, or the floor and roof of bodies for different applications, can be made of other materials, having various thicknesses, that can include: a combination of a high hard metallic armor and a high yield strength metallic armor; an ultra high hard metallic armor, i.e., a metal having a hardness ranging from about 570 Brinell to about 640 Brinell as specified in ARMOX 600 and Mars 300, et al.; or combinations of the foregoing. Firewall 18 can be made of any of the materials discussed previously with respect to floor 14 and roof 16.

Wheelhouses 40 can be made of Rolled Homogenous Armors (RHA) having a hardness ranging from about 300 Brinell to about 375 Brinell. In one embodiment, wheelhouses can be made of an RHA having a thickness of ¼ inch. The various members of frame 12 can be made of a variety of materials that include, but are not limited to, a mild steel or aluminum.

Figure 6:
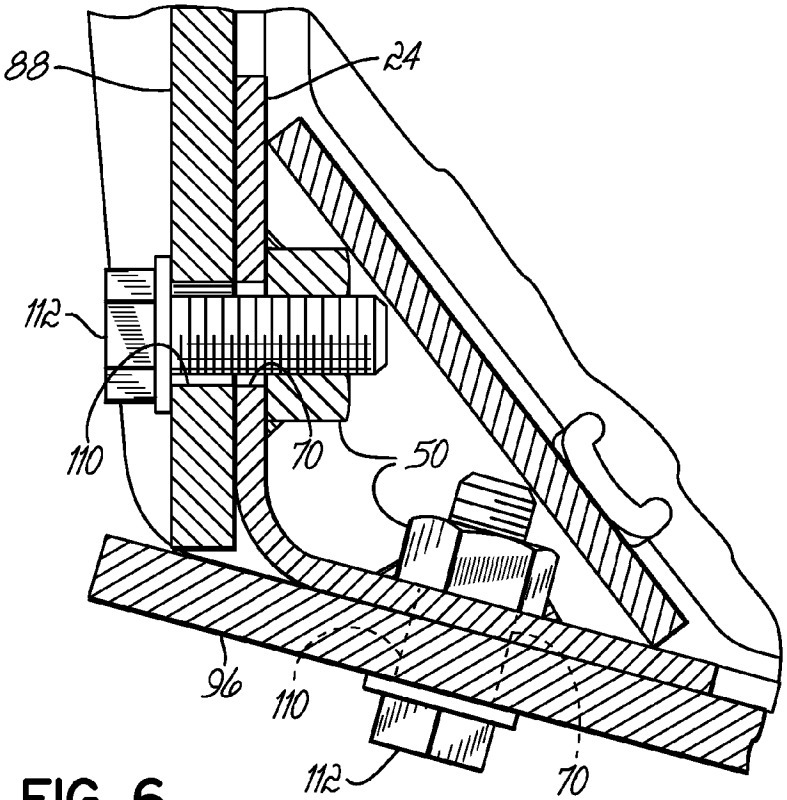
FIG. 6 is a cross-sectional view taken along line 6-6 in FIG. 3.
Figure 5:
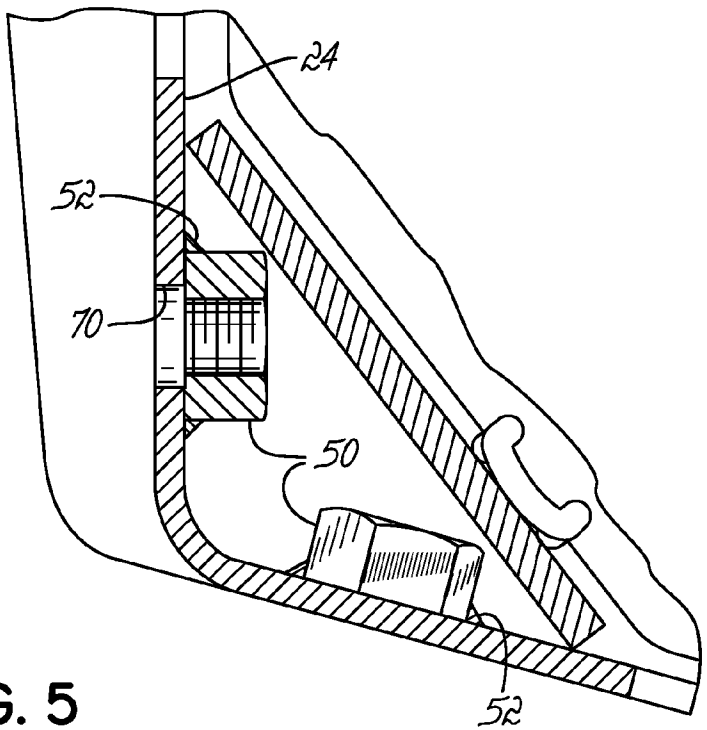
FIG. 5 is a cross-sectional view taken along line 5-5 in FIG. 1.

The cab body 10 also includes a plurality of attachment elements 50, best seen in FIGS. 5 and 6, which are permanently attached to frame 12. As subsequently discussed in greater detail, the attachment elements 50 can be used to removably attach non-armored or armored panels and doors to frame 12, and therefore facilitate field replacement of non-armored panels and doors with armored panels and doors, to configure the armored vehicle that incorporates the cab body 10 for use in a heightened threat environment. In the illustrative embodiment, the attachment elements 50 are female threaded fasteners. The particular type of female threaded fasteners that can be used can depend upon the particular configuration of the body frame. For example, when the female threaded fasteners are attached to flat or angled sheet metal or plate structures, such as the various pillars, side and cross members of frame 12 of cab body 10, weld nuts can be advantageously utilized. FIG. 5 illustrates a pair of weld nuts 50 welded to one of the A-pillars 24. Weld nuts 50 can be welded with "all-around" fillet welds 52 to prevent secondary projectiles or loosening over time. However, in other embodiments, if a body frame is constructed with one or more tubular members, the attachment elements 50 can be threaded inserts. In this event, the threaded inserts can be disposed within the tubular member, across the width of the tubular member, and permanently attached to the tubular member, such as by welding. The threaded inserts can then be used to removably attach armored members to the frame as subsequently discussed further.

Attachment elements 50 are attached to frame 12 so that mating male fasteners can be installed from the exterior of cab body 10. In the illustrative embodiment, wherein attachment elements 50 are weld nuts, this is accomplished by permanently attaching the weld nuts 50 to the interior surfaces of the various members of frame 12 and forming mating clearance holes 70 in the members of frame 12, with each clearance hole 70 being aligned with one of the weld nuts 50. This is illustrated in FIGS. 5 and 6, wherein weld nuts 50 are welded to an interior surface of A-pillar 24 and clearance holes 70 are formed in A-pillar 24 and aligned with weld nuts 50. FIGS. 1 and 2 illustrate attachment elements 50 and clearance holes 70 at various locations on frame 12, for purposes of illustration, not of limitation. The quantity and locations of holes 70, and corresponding attachment elements 50 can be different than those illustrated.

Figure 3:
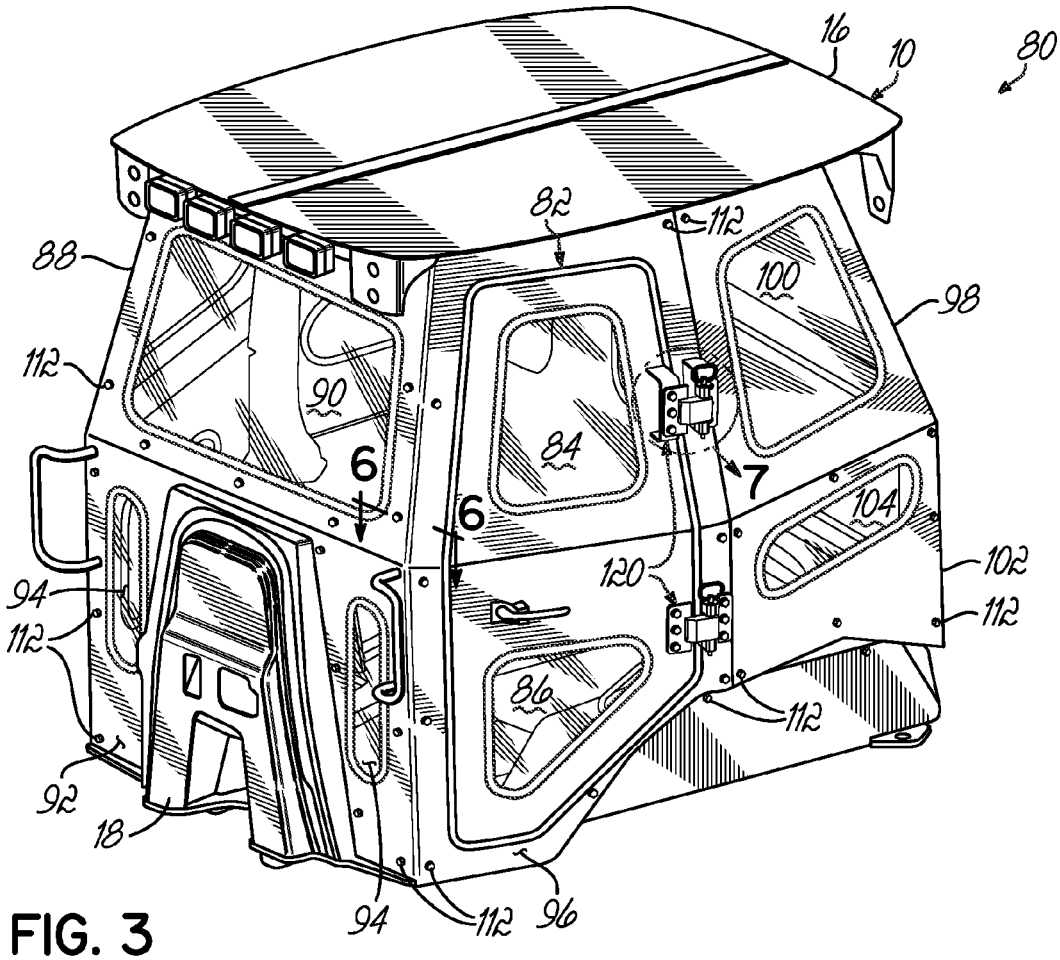
FIG. 3 is a perspective view illustrating an armored cab including the cab body shown in FIGS. 1 and 2 and further including various non-armored members removably attached to the cab body.

FIG. 3 illustrates an armored cab 80 that includes the cab body 10 and a variety of non-armored members, with armored cab 80 being configured for use in a relatively low threat environment. More particularly, armored cab 80 can include the following in addition to the cab body 10: non-armored door 82 having windowpanes 84 and 86 therein; non-armored front panel 88 having windowpane 90 therein; non-armored front panel 92 having a pair of windows 94 therein; non-armored side panel 96 that can extend at least partially around door 82 and can cover the corresponding A-pillar 24 and B-pillar 28; non-armored side panel 98 having windowpane 100 therein; non-armored side panel 102 having windowpane 104 therein; and various non-armored rear panels (not shown) and non-armored opposite side panels (not shown). However, it should be understood that the various panels and door shown on armored cab 80 are for purposes of illustration and are not intended to be limiting. For example, cab 80 can have different quantities of panels and doors and they can be configured differently than the panels and door illustrated.

Also, as used herein, the term "non-armored" is intended to mean that the particular member is designed to withstand or defeat the threats encountered in a relatively low threat environment, while the term "armored" is intended to mean that the particular member is designed to withstand or defeat the threats encountered in a heightened threat environment. In this regard, the various panels and door 82 of armored cab 80 can be made of light sheet metal, for example ⅛ inch aluminum, or other materials providing the required protection.

Windowpanes 84, 86, 90, 94, 100 and 104 can be made of automotive grade glass, such as laminated safety glass or tempered safety glass. In one embodiment, the windowpanes listed above can be made of 3/16 inch thick tempered glass. However, other thickness can be used, depending on the particular application and material used.

With reference to FIGS. 1-3 and 5-8, door 82 and panels 88, 92, 96, 98, 102 and others not shown, can be removably attached to frame 12 of the cab body 10, using attachment elements 50, as follows. Each of the foregoing non-armored panels of armored cab 80 includes a plurality of clearance holes formed therein, such as holes 110 formed in non-armored panels 88 and 96 as shown in FIG. 6. During installation, holes 110 of each panel are aligned with corresponding ones of the holes 70 formed in frame 12. Male threaded fasteners, such as bolts 112 are then inserted into and through holes 110 and 70 and are threaded into attachment elements 50, which can be weld nuts as shown in FIGS. 5 and 6 of the illustrative embodiment or can be threaded inserts, thereby releasably attaching the non-armored panels 88, 92, 96, 98, 102 and others (not shown) to frame 12. The non-armored panels listed above can be flush against frame 12 or alternatively, various gaskets, such as rubber gaskets, can be disposed between the panels and frame 12 to prevent water from leaking into cab 80.

The non-armored door 82 can be installed as follows. As shown in FIG. 3, a pair of hinges 120 can be removably attached to door 82 and to frame 12. As shown in the enlarged views illustrated in FIGS. 7 and 8, each hinge 120 can include a mount plate 122 and a mount plate 124, each having a plurality of holes formed therein that are adapted to receive a male fastener such as bolt 112. Mount plate 122 can be removably attached to door 82 using a plurality of bolts 112 and corresponding female fasteners (not shown). Mount plate 124 can be removably attached to frame 12 by passing one of the bolts 112 through each of the holes in mount plate 124 and corresponding holes (not shown) in panel 96 and threading the bolts 112 into respective ones of the attachment elements 50.

Figure 8:
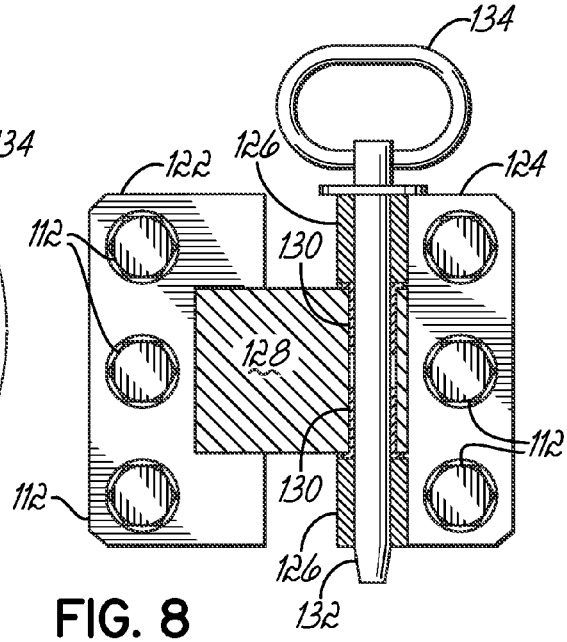
FIG. 8 is a cross-sectional view taken along lines 8-8 in FIG. 7.

A pair of lugs 126 can be attached to mount plate 124 and spaced apart from one another as shown in FIG. 8. A connecting member 128 can be attached to mount plate 122 at one end and can include one or more bushings 130 formed therein. Bushings 130 can be oil-impregnated, sintered bronze flange bushings. Connecting member 128 is sized to fit within the space between lugs 126, with bushings 130 aligned with holes formed in lugs 126. A pin 132 can then be inserted through lugs 126 and bushings 130, thereby coupling mount plates 122 and 124. As a result, door 82 is hingedly and removably attached to frame 12 via hinges 120 and attachment elements 50. Pin 132 can include a handle 134 to facilitate removing pin 132 to uncouple mount plates 122, 124. To remove door 82, mount plate 124 can be detached from frame 12 by removing the corresponding bolts 112, while leaving pin 132 engaged. Alternatively, pin 132 can be removed, which allows door to be uncoupled from mount plate 124 and frame 12. Hinges 120 can have a variety of configurations other than that illustrated.

Figure 4:
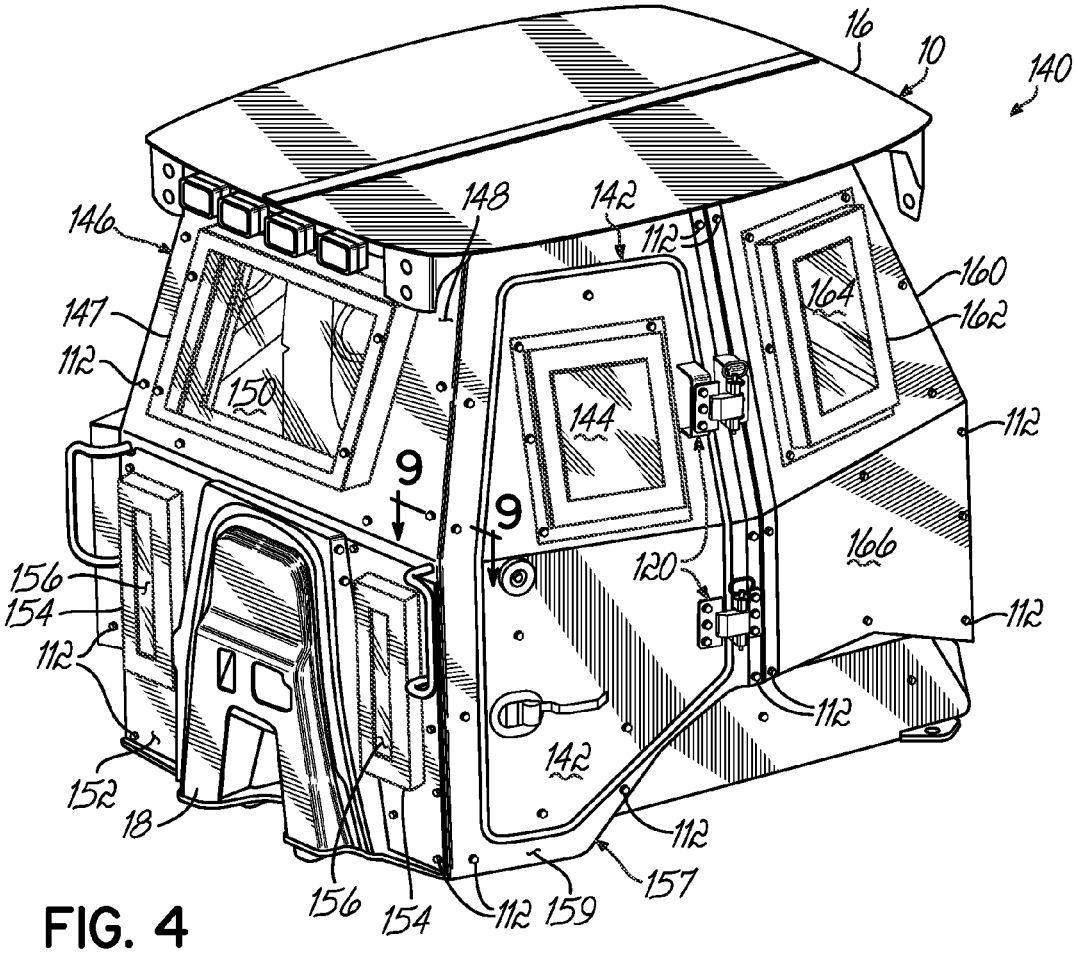
FIG. 4 is a perspective view illustrating another armored cab that includes the cab body shown in FIGS. 1 and 2 and further includes various armored members, corresponding generally to those illustrated in FIG. 3, removably attached to the cab body.

FIG. 4 illustrates an armored cab 140 that includes the cab body 10 and a variety of non-armored members, with armored cab 140 being configured for use in a heightened threat environment. More particularly, armored cab 140 can include the following in addition to the cab body 10: armored door 142 having a windowpane 144 therein; armored front panel 146 that can include a window frame weldment 147 and a windowpane 150 therein; armored front panel 152 that can include two window frame weldments 154 and a windowpane 156 in each; armored panel 157 that can extend at least partially around door 142 and can cover the corresponding A-pillar 24 and B-pillar 28; armored side panel 160 that can include a window frame weldment 162 and a windowpane 164 therein; armored side panel 166; and various armored rear panels (not shown) and armored opposite side panels (not shown). However, it should be understood that the various panels and door shown on armored cab 140 are for purposes of illustration and are not intended to be limiting. For example, cab 140 can have different quantities of panels and doors and they can be configured differently than the panels and door illustrated.

Armored door 142 and panels 146, 152, 157, 160, 166 and others not shown can be made of a variety of materials suitable for a heightened threat environment. Examples of suitable materials include, but are not limited to, high hard or ultra high hard steel; aluminum; ceramics; composites; and combinations of the foregoing depending upon the particular threat the corresponding vehicle is required to defeat. In each case, the thickness of the material selected can be determined based upon the threat that may be encountered. Each of the windowpanes of armored cab 140 can be made of ballistic glass.

Figure 9:
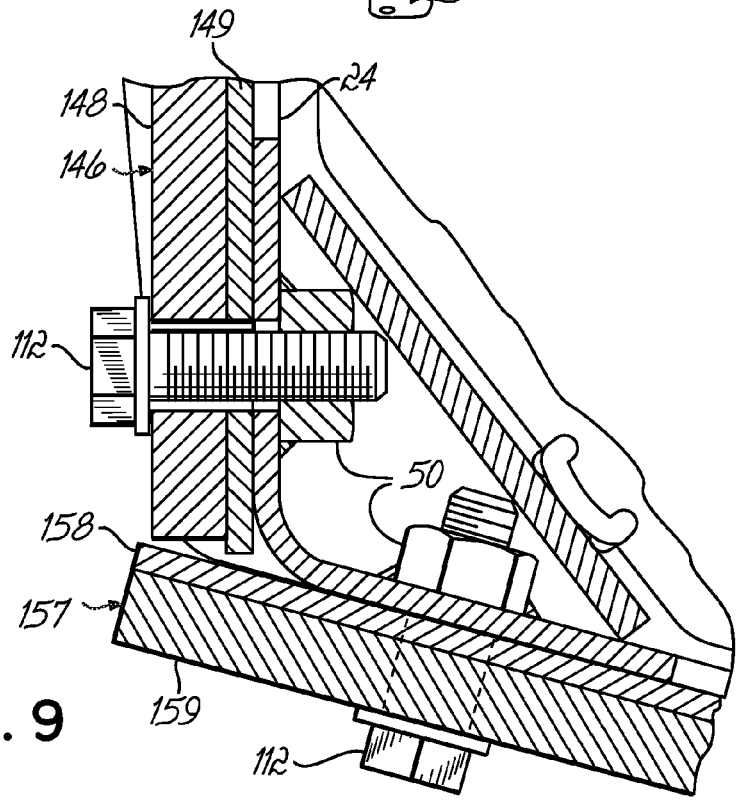
FIG. 9 is a cross-sectional view taken along line 9-9 in FIG. 4.

Armored cab 80, which is suitable for use in a relatively low threat environment, can be converted to armored cab 140, which is suitable for use in a heightened threat environment, as follows. Non-armored door 82 and non-armored panels 88, 92, 96, 98, 102 and others not shown can be removed by disconnecting these members from the corresponding attachment elements 50, and can be replaced with armored door 142 and the corresponding ones of panels 146, 152, 157, 160, 166 and others not shown. Armored door 142 of cab 140 and the various armored panels of cab 140 can be removably attached to frame 12 of the cab body 10 in the same manner as that discussed previously with respect to the non-armored door 82 and the various non-armored panels of armored cab 80. FIG. 9 illustrates a portion of front panel 146 and a portion of side panel 157 removably attached to one of the A-pillars 24 using attachment elements 50, weld nuts in this case, and bolt 112. Panels 146 and 157 are illustrated as including two armor members bonded to one another. For example, panel 146 can include armor members 148 and 149 bonded to one another and panel 157 can include armor members 158 and 159 bonded to one another. However, panels 146 and 157 can be constructed of a single armor member or additional armor members bonded to one another. The various panels of armored cab 140 can be flush with frame 12 or various gaskets can be positioned between the panels and frame 12 to prevent water from leaking into cab 140.

Figure 10:
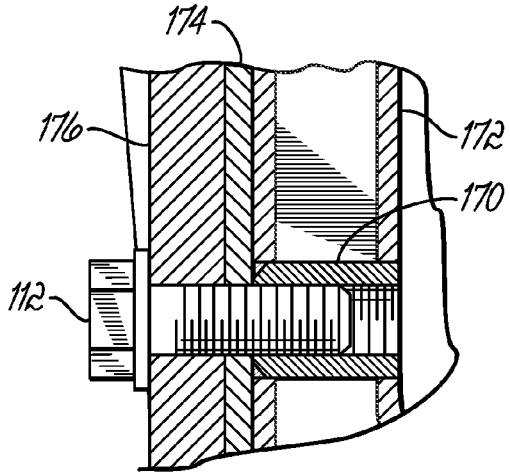
FIG. 10 is a cross-sectional view illustrating an alternate attachment element.

In other applications, armor-ready bodies constructed in accordance with the principles of the present invention can include a multi-layered armor system. Also a tubular frame can be used in other embodiments. Both a multi-layered armor system and a tubular frame can be used for the construction of a HEMTT heavy military truck. In this embodiment, the cab body (not shown) can include a tubular frame and an armored floor, an armored roof and possibly an armored firewall, each permanently attached to the tubular frame, as well as attachment elements permanently attached to the tubular frame. These components can be constructed of the same materials discussed previously with respect to the cab body 10. Additionally, a "light armor skin" can be permanently attached to the frame and can include front, rear and side panels. These panels can be made of a high hard metallic armor and therefore provide greater protection than the panels used on armored cab body 80 discussed previously. The thickness of these panels can vary, and can be thinner than the thickness of the floor and roof. This cab body configuration can further include a non-armored door, such as that described previously for cab body 80. When the vehicle is expected to encounter more severe threats, it can be reconfigured by replacing the non-armored door with an armored door and adding additional armored panels over the top of the permanently attached "light armor skin" panels. The additional panels are removably attached to the frame of the body, to create a multi-layered armor system, by connecting the panels to the attachment elements permanently attached to the frame. The skin and additional, outer panels can include the appropriate holes to thread made fasteners into the female attachment elements. This is illustrated in FIG. 10 which shows a threaded insert 170 permanently attached to a tubular frame member 172 and a light armor skin member 174 permanently attached to the tubular frame member 172. An outer, armored panel 176 is removably attached to the tubular frame member 172 using male fasteners (one shown), such as bolts 178, threaded into the corresponding threaded insert 170.

Utilization of modular vehicle bodies constructed in accordance with the principles of the present invention, in conjunction with kits of non-armored and armored components such as those described herein, provide many advantages as compared to conventional armored vehicles. These advantages include the following. Since attachment elements are permanently attached to the frame of the body, the vehicle can be quickly and easily configured to meet the expected threat environment by removably attaching non-armored panels and doors or armored panels and doors to the frame of the body. This can result in a significant reduction in installation time as compared to conventional armored vehicles having a base body, and add-on armor kits due to the time required to modify the base body, for example by reinforcing the base body to withstand the weight of the add-on armor attached to the body. Field installation time can be further reduced by permanently attaching armored components such as the floor, roof and firewall to the frame of the modular body that would be difficult and time consuming to install in the field, such as a military theater, as required with conventional vehicles using add-on armor.

Since the base body of such conventional armored vehicles typically provides little or no protection against direct and indirect fire, the weight of the base body is a parasitic weight. Use of the modular vehicle body of the present invention avoids this parasitic weight penalty, which can be several hundred pounds. Accordingly, fuel efficiency is improved and the armored vehicle experiences a longer life cycle and/or can carry a greater payload. A cost savings corresponding to the elimination of the parasitic weight is also realized.

Conventional armored vehicles using add-on armor can have undesirable ballistic gaps created by joints between the various add-on armor components and/or between the armor components and the vehicle body due to the need to work around the configuration of the existing body. Use of the modular body of the present invention and the associated kits of non-armored or armored components minimizes these gaps since both the non-armored and armored members are designed to complement a specific modular cab configuration.

Conventional vehicles having a base body that is fully armored as manufactured, for heightened threat environments, have weight, cost and life cycle penalties when the vehicle is used in a relatively low threat environment. These penalties can be avoided using the modular bodies and associated kits of non-armored and armored components of the present invention.

Also, as compared to conventional vehicles of this type, the use of attachment elements permanently attached to the body also allow upgraded armor incorporating new technology to be used without the need for replacing the entire vehicle.

While the invention has been illustrated by a description of embodiments and while those embodiments have been described in considerable detail, it is not intended that the appended claims be restricted or any way limited in scope to such detail. Additional advantages and modifications within the spirit and scope of the invention will readily appear to those skilled in the art. For example, while the attachment elements shown in the illustrative embodiments are female threaded fasteners, the attachment elements can be male threaded fasteners or any other suitable fasteners such as quick connect fasteners, that are permanently attached to the frame of the particular modular body and can be used to removably attach non-armored or armored panels and doors, or other members, to the frame of the modular body. Therefore, the invention in its broadest aspects is not limited to the specific details shown and described, and departures may be made from the details described herein without departing from the spirit and scope of the claims which follow.

What is claimed is:

1. A modular armored cab kit for use on an armored vehicle comprising:

a cab body including a frame, an armored roof, an armored floor and a plurality of attachment elements, said armored roof, said armored floor and said attachment elements being permanently attached to said frame;

at least one non-armored panel for attachment to said cab body;

at least one non-armored door for attachment to said cab body;

at least one armored panel for attachment to said cab body;

at least one armored door for attachment to said cab body; wherein said attachment elements facilitate field installation and removal of said panels and doors; and said non-armored panel and door are removably attached to said frame in a relatively low threat environment and are removed from said frame and replaced with said armored panel and door in a heightened threat environment.

2. The modular armored cab kit of claim 1, wherein:

said cab body further includes an armored firewall permanently attached to said frame.

3. The modular armored cab kit of claim 2, wherein:

said armored roof, said armored floor, said attachment elements and said armored firewall are welded to said frame.

4. The modular armored cab kit of claim 1, wherein:

said kit further comprises a plurality of said non-armored panels, at least one of said non-armored panels having a windowpane.

5. The modular armored cab kit of claim 1, wherein:

said non-armored door comprises a windowpane.

6. The modular armored cab kit of claim 1, wherein:

said kit further comprises a plurality of said armored panels, at least one of said armored panels comprises a windowpane.

7. The modular armored cab kit of claim 1, wherein:

said armored door comprises a windowpane.

8. The modular armored cab kit of claim 1, wherein:

said attachment elements comprise a plurality of threaded fasteners, each being welded to said frame.

9. The modular armored cab kit of claim 8, wherein:

said threaded fasteners are weld nuts.

10. The modular armored cab kit of claim 8, wherein:

said threaded fasteners are threaded inserts.

11. The modular armored cab kit of claim 1, wherein:

said armored panel comprises a first armored member and a second armored member bonded to said first armored member.

12. The modular armored cab kit of claim 1, wherein:

said frame includes an underbody portion, an upper portion and a plurality of pillars extending between and attached to said underbody portion and said top portion.

* * * * *